US009114304B2

(12) United States Patent
Pearce et al.

(10) Patent No.: US 9,114,304 B2
(45) Date of Patent: Aug. 25, 2015

(54) QUICK RELEASE SKI BINDING MOUNTING SYSTEM

(71) Applicants: Cordell Pearce, Denver, CO (US); Ben Anderson, Evergreen, CO (US); Travis Cook, Evergreen, CO (US)

(72) Inventors: Cordell Pearce, Denver, CO (US); Ben Anderson, Evergreen, CO (US); Travis Cook, Evergreen, CO (US)

( * ) Notice: Subject to any disclaimer, the term of this patent is extended or adjusted under 35 U.S.C. 154(b) by 0 days.

(21) Appl. No.: 13/971,749

(22) Filed: Aug. 20, 2013

(65) Prior Publication Data

US 2014/0050521 A1 Feb. 20, 2014

Related U.S. Application Data

(60) Provisional application No. 61/691,107, filed on Aug. 20, 2012.

(51) Int. Cl.
*A63C 9/00* (2012.01)
*A63C 9/16* (2012.01)

(52) U.S. Cl.
CPC . *A63C 9/003* (2013.01); *A63C 9/16* (2013.01); *Y10T 403/595* (2015.01)

(58) Field of Classification Search
USPC ..... 280/618, 620
See application file for complete search history.

(56) References Cited

U.S. PATENT DOCUMENTS

2012/0274036 A1* 11/2012 Kloster et al. ..... 280/11.31

* cited by examiner

*Primary Examiner* — Jeffrey J Restifo
*Assistant Examiner* — Erez Gurari
(74) *Attorney, Agent, or Firm* — Kyle W. Rost

(57) ABSTRACT

A system of attaching a ski binding to a ski allowing quick interchange of bindings to other skis, and without the use of any hand tools. A first fastener is permanently attached to a ski, while the binding is permanently attached to a binding carrier plate that includes a mating, second fastener. The first and second fasteners are engaged by a quick release mechanism that is longitudinally shorter than a typical direct mounting system for a binding, resulting in reduced scrub area at the mounting to the ski. The binding mounting plate can extend longitudinally beyond the binding to provide mounting area for vibration dampers and camber adjusters.

13 Claims, 11 Drawing Sheets

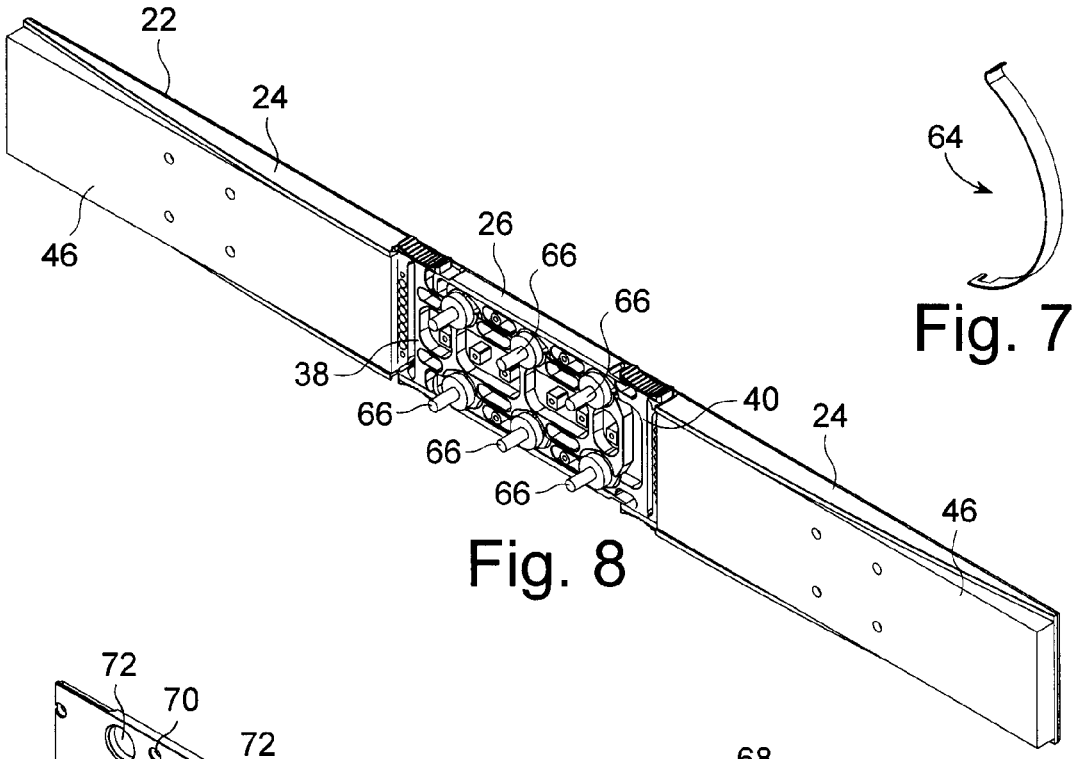
Fig. 8
Fig. 7
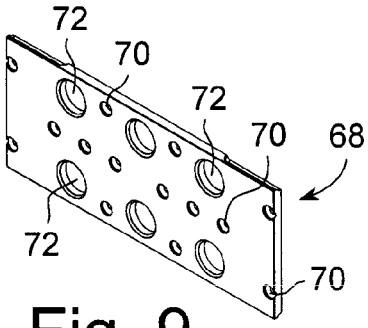
Fig. 9
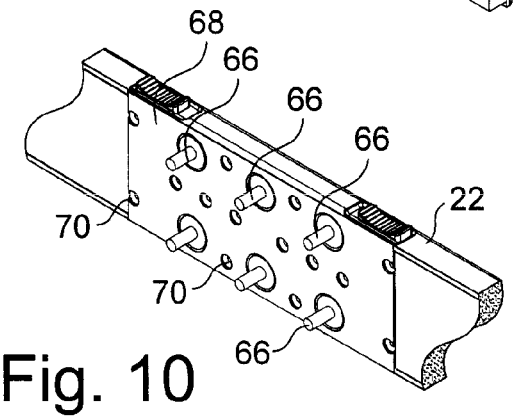
Fig. 10

QUICK RELEASE SKI BINDING MOUNTING SYSTEM

BACKGROUND OF THE INVENTION

1. Field of the Invention

The invention generally relates to land vehicles of the type broadly considered to be skates, which can be defined as devices to be secured to the feet of the rider whereby he may propel himself over land, ice or snow. The invention is particularly directed to shoe attaching means of the type referred to as ski fasteners, which are more commonly referred to in the art of skiing as ski bindings. According to the present invention, a ski binding may be of substantially any description but may consist of toe and heel fasteners. The binding is mounted on a common support plate or first element, wherein the plate is movable or releasable from the ski. A second element installed on the ski mates with the first element in response to compressive forces applied between them. The invention provides the ability to install and remove one's ski bindings from various sets of ski's without the use of hand tools.

2. Description of Related Art Including Information Disclosed Under 37 CFR 1.97 and 1.98

Conventional ski bindings are used to attach a pair of ski boots to a pair of alpine skis. These bindings generally have a mounting area that creates a large flat spot in the natural bending arc of the ski. This flat area can be in excess twenty linear inches along the length of the ski. This area can degrade the cutting effect in the turning pattern of the ski while a skier is attempting to make an aggressive turn. When the skier applies force while turning, the ski is bent into an arc by three points on the ski: the tip, the tail, and the middle. The flattened area will create a scrub portion that is not in line with the rest of the natural arc. This scrub degrades the ability of the skier to make the tightest, most accurate turn possible. This scrub also creates a loss of energy and forward momentum.

Conventional ski bindings are generally used at fairly high speeds, on a variety of terrain. In certain situations, the ski can vibrate and generate a bounding effect that the skier feels. There are no vibration-damping systems incorporated into modern ski binding systems. When vibration is encountered on choppy terrain, it can cause numbness, fatigue, and pain to the skier. The bouncing affect can also cause ski chatter, where portions of the ski are not cutting into the snow, which results in a loss of traction and hinders the skier from performing an accurate, efficient, and safe turn.

Generally, conventional ski bindings are permanently mounted to a set of skis. A ski binding is quite costly, with cost increasing with quality and protective ability. As bindings are designed to protect the skier from injury, the skier has strong motivation to purchase highest quality, most expensive binding he can afford. When a skier purchases a new set of skis, he has the option to reuse his old set of bindings by transferring them to his new set of skis. This option results in the old set of skis having no bindings and for that reason becoming worthless. The skier's other option is to purchase a new set of bindings, which then are permanently mounted to the new set of skis. This option can be costly and, of course, results in the new set of bindings being permanently committed to the new set of skis. A set of ski bindings must be accurately mounted to a pair of skis in order to use them safely. Installing or transferring a set of bindings tends to be a professional job for a technician at a ski shop, using proper tools, which adds both monetary cost and significant time delay to any installation. Current bindings are meant to be affixed in a manner such that the skier, himself, does not have the ready ability to swap them from one set of skis to another. The practical result of the current situation is that a skier must have a number of ski bindings equal to the quantity of his functional skis.

A typical ski is manufactured with a set camber. This curvature profile dictates the overall handling characteristics of the ski. There are currently no methods in place to alter this manufactured profile, to thereby change the handling characteristics of the ski. Current ski models are designed with one specific profile for one specific type of skiing/terrain.

It would be desirable to create an engagement between a ski binding and ski that substantially eliminates the scrub portion of the ski's curvature during turns. According to the invention, this can be achieved by mounting a ski binding to a ski via an intermediate binding mounting plate that is connected to the ski on a footprint that is substantially shorter than the length of the binding. The shorter footprint results in a reduced length of the scrub portion.

It would also be desirable to create a ski binding that is capable of selectively controlling vibration and bounce in the operational characteristics of a ski. It would further be desirable to enable the vibration and bounce control system to be variable in effect, to be adaptable to skis of different performance characteristics. According to the invention, this can be achieved by employing an intermediate binding mounting plate to carry the binding and to be mounted to the ski on a shorter footprint than the length of the binding. The binding mounting plate provides end portions beyond the small footprint, and these end portions can be mounts or holders for vibration damping elements.

It would be desirable to create a ski binding that is capable of selectively altering the handling characteristics of a ski. More specifically, it would be desirable to create a ski binding that can selectively alter the camber of a ski. According to the invention, this can be achieved by employing an intermediate binding mounting plate to carry the binding and to be mounted to the ski on a shorter footprint than the length of the binding. The binding mounting plate provides end portions beyond the small footprint, and these end portions can be mounts or holders for camber altering elements.

Finally, it would be desirable to create a quick release mounting device that permits quick mounting of a binding onto a ski, and quick release of a binding from a ski. Such a quick release mounting device would enable an entire binding to be moved from one pair of skis to another, preferably in a short time frame such as a minute or less, and preferable without the use of tools.

To achieve the foregoing and other objects and in accordance with the purpose of the present invention, as embodied and broadly described herein, the method and apparatus of this invention may comprise the following.

SUMMARY OF THE INVENTION

In one embodiment, a kit provides suitable elements to convert the normal, direct and permanent mounting of a binding to a ski into a nonpermanent, quick install and quick release mounting. The kit provides at least a two-part mounting system, in which one part is permanently affixed to the top of the ski at the normal binding mounting area, and the second part is permanently affixed to the bottom of the binding. The two parts of the mounting system can be engaged by temporary mounting means, which allows quick engagement and quick disengagement of the two parts from one another. For purposes of this description, mounting screws are considered to be permanent.

Temporary, quick release mounting means is considered to include systems in which the two parts of the mounting system are quickly engaged by being pushed together with compressive force and then the two parts or their subcomponents are moved transversely to the direction of compression to lock the two parts together. Reversing the transverse motion and then lifting the two parts apart quickly disengages the two parts. Such a system enables the quick engagement or disengagement of a binding from a ski, and then enables the reengagement of the binding on another ski that has a similar mating element mounted on its top.

Suitable transverse motion of the quick release mounting means can include sliding of one or more lock plates in a system where the lock plates are the first part of the system and large headed fasteners are the second part of the system. A pair of lock plates can slide apart to open, enlarge, or reposition apertures to receive the heads of the headed fasteners. The plates can slide to close and capture the heads, and can slide to reopen and release the heads. Another transverse motion is between the first and second parts of the system, where the system is formed of a pair of matable slide plates in which one has lugs and the other has slots that fit the lugs. Longitudinal sliding motion between the plates can engage the lugs in the slots or disengage the lugs from the slots. Another configuration of matable slide plates employs rotary sliding, where one plate has opposite ends that perform similarly to lugs, and the second plate has slots that can receive the ends by rotation of one plate with respect to the other. All of these transverse motions can be performed in a matter of seconds, without requiring tools.

Such a conversion kit may provide a binding mounting plate that can serve as an intermediate carrier for the binding, between the binding and the ski. A binding mounting plate can be specially configured to receive one of the elements of the two-part mounting system on its bottom face. The binding can be mounted on its top face. The binding mounting plate may have a preselected length that is longer than the mounted part of the two-part mounting system and longer than the binding. The length of the binding mounting plate can provide oppositely extending end portions that assist in mounting vibration dampers and camber adjusters.

In a second embodiment, a ski and binding are modified by permanently affixing a first mounting element of selected configuration to the ski's top surface at a longitudinal position centered where bindings conventionally would be installed. The binding is modified by being directly mounted to the top of an intermediate carrier that is interposed between the binding and the ski. Two-part, quick release mounting means can be attached between the ski and the binding mounting plate, with a first mounting element of the two-part system attached to the bottom of the binding mounting plate and with a second mounting element of the two-part system attached to the top of the ski. The two parts of the mounting system can be temporarily attached to each other with sufficient security to allow skiing to be performed using the binding and ski.

The intermediate carrier not only provides a means for attaching a ski binding, but it provides a sufficiently stable mounting to the ski that the mounting element on its bottom face can be shorter than the length of the binding. Thus, the two-part mounting means can be attached to the ski over a shorter length footprint than the length of the direct mounting structure for a binding. The result is that the mounting footprint of the binding on the ski is relatively shorter than for a directly mounted binding, itself, and the scrub portion of the ski, if any, is reduced.

The mounting element on the intermediate carrier and the mounting element on the ski attach to one another by compression, which is a quick method of mounting the binding to the ski. In one embodiment that features compression, the first mounting element of the pair, which is attached to the top of the ski, is an array of mounting pins with enlarged heads. The second mounting element of the pair, which is attached to the bottom of the binding mounting plate, includes an array of apertures that can alter their shape to snap over the enlarged heads under directly applied compression of the binding mounting plate against the mounting pins. The mounting pins may be permanently affixed to the ski by conventional ski binding mounting screws.

The second mounting element that is attached to the bottom of the binding mounting plate allows the binding mounting plate to be quickly attached to or released from any ski that is equipped with a mating first mounting element. Conventional ski binding mounting screws, as the manufacturer typically supplies with the new bindings, are suitable to permanently mount the binding to the binding mounting plate. The second mounting element is placed over the mounting pins on the ski and pushed downwards, which locks the second mounting element to the mounting pins. The pins are configured with guide surfaces to assist in aligning the pins with the receivers of the second mounting element. The guide surfaces are tapered top edges of the pins, which assist in guiding the second mounting element when it is pushed down over the pins.

A suitable locking mechanism of the second mounting element is a two-part slide lock. Applying the slide lock to the mounting pins separates the two parts of the slide lock mechanism to receive heads of the mounting pins. These two parts of the slide lock are kept in a normally locked position by action of springs on either end of the slide lock. When the slide lock is fully seated over the heads, there is sufficient room under the heads for the two parts of the slide lock to snap into closed position under the received heads, locking the slide lock to the ski. Manually operated slide buttons can open the slide lock for removing the slide lock from the ski.

As one example of suitable mounting points on the ski, an array of six mounting pins can be used, and correspondingly the slide lock mechanism is configured to receive this array of pins. The slide lock mechanism provides tapered guiding surfaces to assist in receiving the tapered heads of the mounting pins into corresponding locking receptors. Once pins are fully seated in the receptors, the two plates will slide back into their resting position, partially closing under the enlarged pin heads to lock the pin heads behind the two plates. These two plates slide in opposite directions so that in the event that one plate becomes jammed in an unlocked position, the second plate will still hold the pins in place, keeping the binding and quick release binding mounting assembly affixed to the ski. In a resting state, the two springs of the slide lock mechanism act in opposite directions to push the two locking plates towards each. This provides a safety guard against unintentional release of the slide lock if the skier encounters a large jarring motion in a single direction. In an extreme circumstance, one plate could become unlocked momentarily, but the other plate, being spring-loaded in the opposite direction, would snugly hold the binding mounting plate to the ski.

Another embodiment of the first mounting element is a lower slide lock plate that is permanently attached to a ski's top surface at a longitudinal position centered where bindings conventionally would be installed. The lower slide lock plate defines an array of laterally extending lugs along each side edge. The lower slide lock plate may be affixed to the ski by conventional ski binding mounting screws. The second mounting element is an upper slide lock plate configured to mate with the array of lugs in complementary, mating, lug receptor cavities and longitudinal channels. The mating upper slide lock plate is pushed down on the lower slide lock plate to receive the lugs in alignment with the mating cavities. Then the upper slide lock plate is slid longitudinally to cause the lugs to enter the longitudinal channels, thereby fastening the binding mounting plate in place. When the lugs are fully received in the channels, a suitably positioned spring-loaded latch locks the upper and lower slide lock plates against reverse sliding motion. A latch release mechanism can open the latch to permit removal of the binding mounting plate from the ski.

The binding mounting plate can be equipped with an integral dampening and tuning system, allowing the user to tune the flexibility and curvature properties of the ski, as well cushion the vibrations endured while skiing. In downhill racing, a ski that is properly tuned for the conditions of the course can cut critical seconds off of the skier's run time. This tuning system is comprised of a plurality of swappable blocks of different densities. Selected blocks can be installed under the binding mounting plate at leading and trailing end locations, which are disposed respectively towards the toe and heel ends of the binding mounting plate. The blocks are swapped out by the user without the use of tools, while the binding mounting plate is temporarily removed from the ski, and are located and kept in place by pins in the bottom of the binding mounting plate.

An optional modification of the damping system allows the damping blocks also to change the camber or arc of the ski. In a configuration that does not change the camber of the ski, the damping blocks are configured to follow the curvature of the ski. In an alternative configuration that changes the camber of the ski, the outer ends of the damping blocks are sufficiently larger or thicker than the inner ends, such that the end or the binding mounting plate pushes down the outer ends against the ski to shorten its radius of curvature. The shortened radius corresponds to a more aggressive camber.

The entire binding mounting plate, including damping and camber changing components, can be quickly removed from the ski using no tools. The purpose of having a binding mounting plate, with a quick release binding mount assembly, would be for the user to have the ability to swap one set of expensive, high end bindings onto various sets of skis, without suffering the expense of purchasing multiple sets of bindings for corresponding multiple pairs of skis. A quick release binding mount assembly would be useful to ski racers, to consumers with multiple sets of skis for various skiing conditions, to rental markets, and to demo shows where many skiers are riding many alternate sets of skis in one day.

The first mounting element on the ski and the mating second mounting element on the binding mounting plate are located directly underfoot, in a lengthwise footprint that is as compact as possible in order to provide the ski with an unencumbered flex pattern. For example, both the described array of mounting pins and the mating slide plate are substantially shorter than the length of a conventional ski binding. The side profile of the binding mounting plate is shaped to avoid contact with the ski other than via the mounting footprint, to allow the ski to flex in a perfect arc. The binding mounting plate is designed with a curved side cutout to allow the ski to curve in a natural form without flat spots and hindrances.

According to the invention, no tools are required to swap a set of bindings from one set of skis to another. The entire quick release binding mount assembly is designed with speed and ease of use in mind. Each set of skis would require only the installation of one side of the mating mounting elements. For example, the pins or slide lock plate, as appropriate to the system being employed, must be mounted to each ski. These components are simple and inexpensive. The far more expensive ski bindings are attached to the binding mounting plate, which is portable and can be transferred from one pair of skis to another. It is anticipated that a user can swap a pair of bindings from one set of skis to another in about ten seconds.

The accompanying drawings, which are incorporated in and form a part of the specification, illustrate preferred embodiments of the present invention, and together with the description, serve to explain the principles of the invention. In the drawings:

BRIEF DESCRIPTION OF THE SEVERAL VIEWS OF THE DRAWINGS

FIG. 7 is an enlarged isometric view of a locking plate spring.

FIG. 8 is a view similar to FIG. 1, showing the binding mounting plate with locking plates, damping blocks, and ski mounting pins installed.

FIG. 9 is an isometric view of a bottom cover plate, taken from the bottom and side.

FIG. 10 is a view similar to FIG. 8, showing a bottom cover plate installed and covering the locking plates.

DETAILED DESCRIPTION OF THE INVENTION

Figure 11:
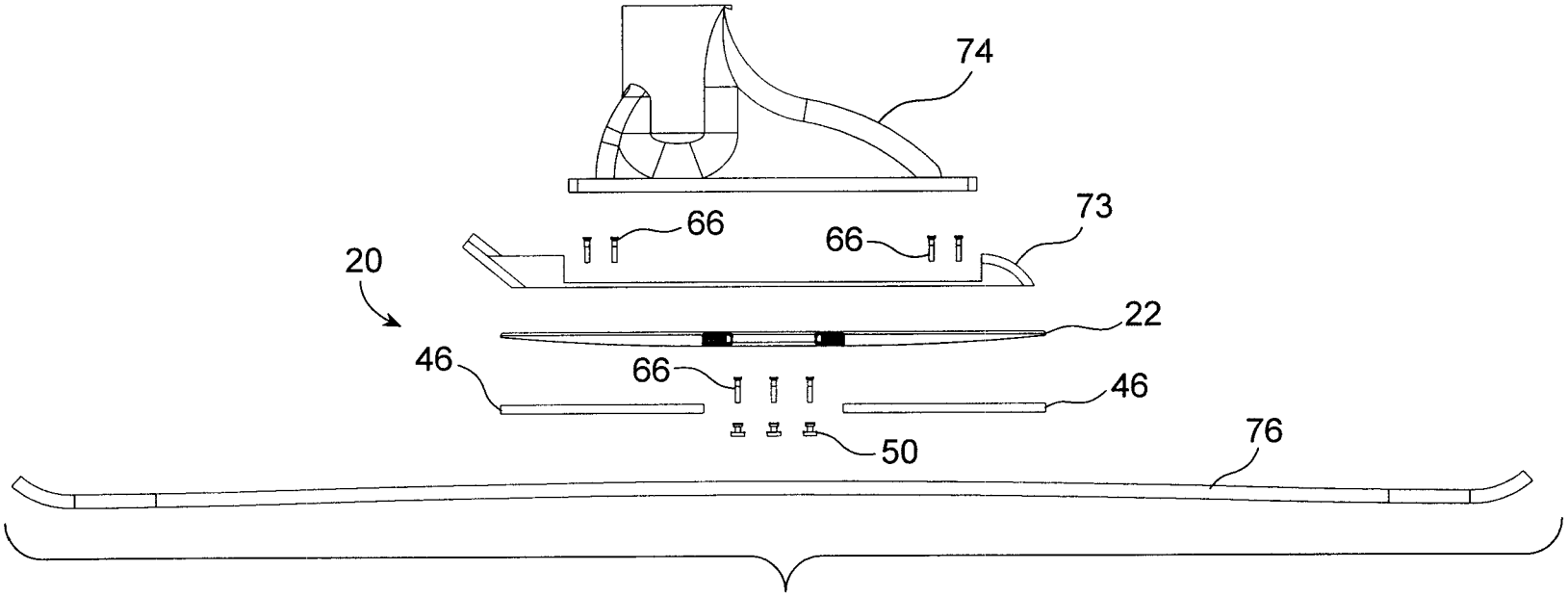
FIG. 11 is an exploded view taken from a side, showing a quick release ski binding mounting assembly in combination with a ski, ski binding, and ski boot.

The invention is a quick release ski binding mounting system 20, shown in FIG. 11, that allows the user to easily and quickly disconnect ski bindings from one set of skis and install the bindings on another set of skis, all without the use of any tools. With this system, a single set of ski bindings can be used with multiple sets of skis, each equipped with a means for receiving one side of a two-part quick release mounting device. The one side of the mounting device may be simple mounting points or other devices on a ski that can be engaged by compression with the second side of the two-part device, which is connected to the binding or binding carrier for the quick attachment of the binding to a ski.

To complete the process of engagement, the compression may be accompanied by a transverse mechanical movement in a direction other than normal to the top surface of the ski, such as longitudinal sliding, rotation, or separation of spring-loaded components approximately transverse to the direction of compression. Disengagement for removal of the binding requires more than lifting tension between the binding and ski, so that the binding is secure on the ski for safe performance of the skiing sport. The release of the ski from the binding requires mechanical motion within the two-part mounting device in a direction other than normal to the top surface of the ski, such as transverse to the normal direction.

The changeover of bindings from one set of skis to another can be accomplished quickly enough that the user can change his skis during a single ski day or even within a matter of seconds. The binding mounting system optionally provides selective vibration damping and ski camber adjustment. Damping and camber adjustment are changeable by substituting components of the binding mounting system, which can be accomplished with similar ease and without tools.

The term, "ski binding," means a complete, functional device for attaching a shoe or boot to a ski, needing only to be first attached to the ski. A ski binding is configured to be mounted on a ski using a mounting structure that extends over a predetermined length of the binding. The typical mounting structure is known to be screw holes that receive mounting screws. The screw holes are known to be located near the opposite ends of the binding. Thus, the length of the binding is a reasonable estimate of the length of the mounting structure associated with the binding. The length of the mounting structure is predetermined, even if the binding accommodates adjustments in length. Known types of bindings include heel and toe bindings, which are composed of a heel piece and a toe piece that are mounted at a predetermined separation from one another, according to the approximate size of the user's boot. Often the heel or toe piece is on a mounted base plate and can be longitudinally adjusted on the plate to vary the intermediate separation to accommodate variation in boot sizes, such as between brands of boots. Another type of ski binding is a heel and toe plate binding, in which heel and toe receivers are mounted on a base plate that carries both and perhaps allows adjustment of the intermediate separation. However, such a binding requires the base plate as a component thereof. Still another type of binding is a plate binding having a base plate that engages a boot sole plate. The user must attach the sole plate to his boot, and the base plate carries a mechanism that engages the sole plate instead of engaging the boot.

The terms "binding mounting plate," "intermediate carrier," "intermediate binding mounting plate" and the like refer to a mounting surrogate for the ski, itself, and not to an integral part of the ski binding. The invention relates to such a surrogate and to its use to carry the complete binding, of whatever description.

The terms, "first and second mounting elements," "mating mounting elements," and the like refer to two-part mechanisms that enable the quick release and quick mounting of ski bindings. One of the two mounting elements is attached to the ski at the normal binding mounting area by a secure, relatively permanent method such as screws. Mounting elements of this type may be attached to many skis. The other of the two mounting elements is attached to the binding by a secure, relatively permanent method such as screws. A quick engagement and quick disengagement mechanism operates between the two mounting elements to enable the binding to be disengaged from one ski and engaged on a mating mounting element of another ski.

Figure 1:
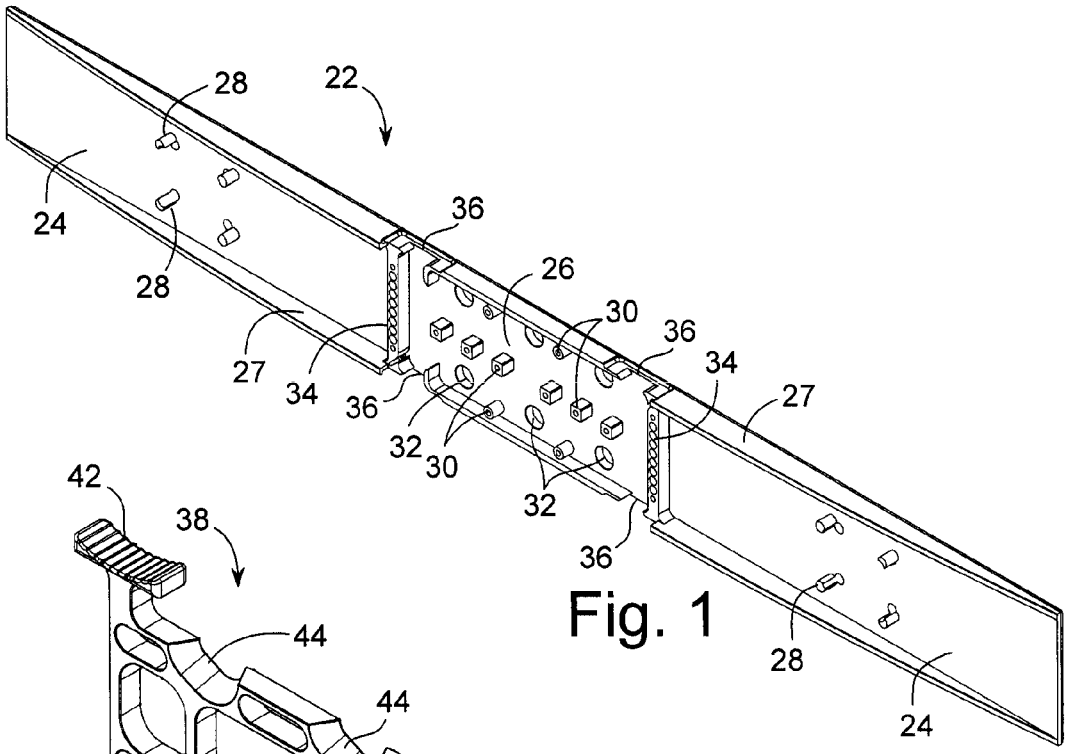
FIG. 1 is an isometric view of a binding mounting plate, taken from the bottom and side.

With reference to FIG. 1, a quick release ski binding mounting system employs first and second mounting elements. The system also provides a binding mounting plate 22 that is sufficiently elongated to carry the components of a ski binding at their normal operational spacing for receiving a ski boot. The mounting plate 22 can be viewed as being subdivided into three zones that lie in series along the plate. Each opposite end portion of plate 22 is a support zone 24 that is suited to carry a binding component, such as a toe or heel piece. A center zone that is between the two support zones is a fastening zone 26 that is suited for interconnecting the mounting plate with a ski by use of a first or second mounting element.

The mounting plate has a top wall with a smooth top surface, which enables the components of a ski binding to be mounted at longitudinal positions as required by the binding manufacturer's specifications, using accepted fastening devices such as screw fasteners. The top wall is folded down to form side walls 27 of the mounting plate. The folds increase structural rigidity. At the support zones, the folded sides 27 are cut on a curve or tapered toward opposite ends of the mounting plate so that when the mounting plate is mounted on a ski, the ends have a clearance from the ski or follow the curvature of the ski, thereby allowing the ski to flex into a curve without interference from the ends of the mounting plate. The bottom of the mounting plate is configured for interconnection with additional elements, as selected or required. For example, the bottom face of each support zone 24 is configured with means for engaging damping and camber adjusting elements. As examples of such engaging means, FIG. 1 shows one or more locating pins 28 that depend from the bottom face of each support zone and are suitable for engaging a damper and camber adjuster. The bottom face of the fastening zone 26 carries screw mounts 30, pin clearance holes 32, and spring backing supports 34 for use with a mounting element. In addition, the folded sides of the mounting plate define notches 36 for receiving slide buttons of a mounting element.

Figure 2:
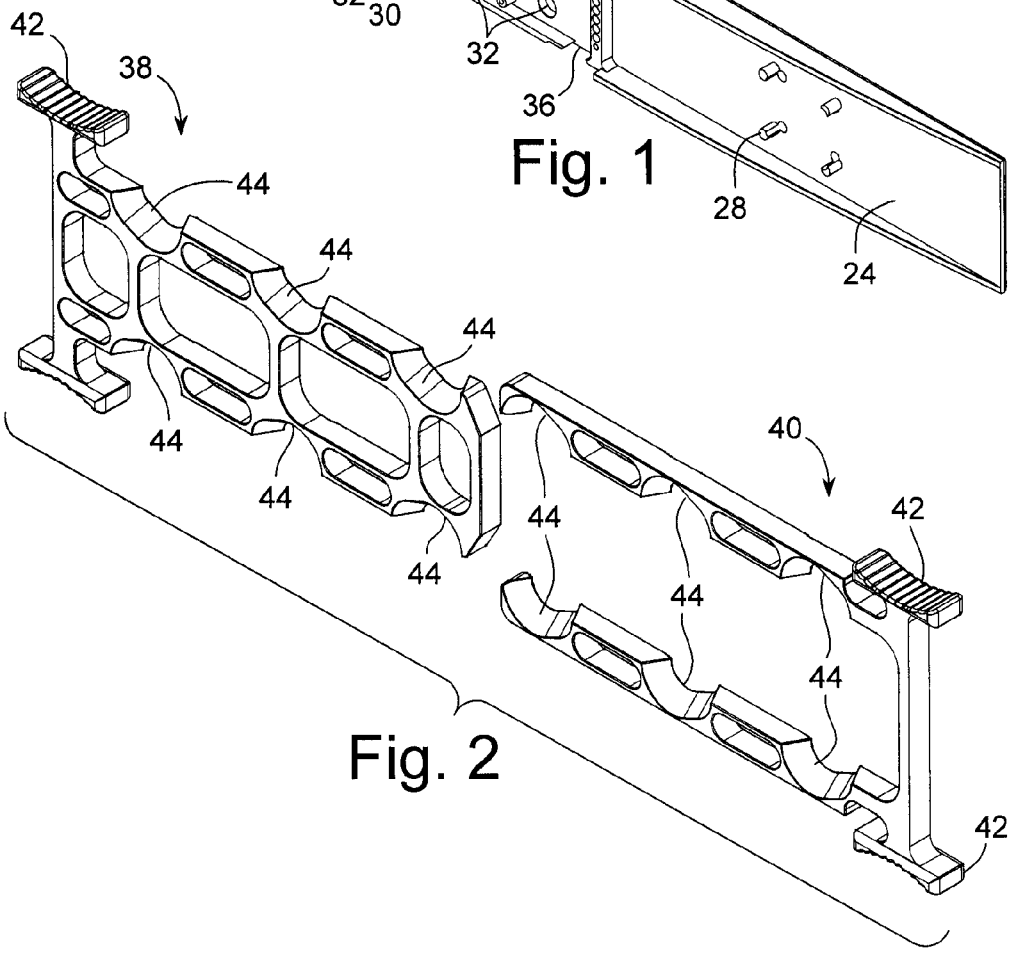
FIG. 2 is an enlarged isometric view of a pair of cooperating locking plates, taken from the bottom and side.

As shown in FIG. 2, a mounting element is formed of a mating pair of locking plates that is suited to fit within the fastening zone 26 of binding mounting plate 22. Inner locking plate 38 and outer locking plate 40 fit together in variable sliding engagement to define a series of apertures that can be selectively lock or opened. The apertures are locked or opened according to the selected relative position between the two locking plates. The relative position of each locking plate is controlled by associated slide buttons 42, which operate within the limited length of notches 36 to alter the relative engagement between the two locking plates. The mating side edges of the locking plates 38, 40 define longitudinally elongated aperture portions 44, which align to form larger openings when the locking plates are in open position. In open position, the locking plates define elongated apertures formed of mated portions 44. By relatively sliding the two locking plates from open position to locked position, the aperture portions 44 are placed into partial misalignment, which creates a locking action by reducing the maximum available diameter between the two aperture portions 44. This locking system is intended for use with a mating mounting element composed of headed fasteners, where a fastener head can be fitted through a full or open aperture but not through a misaligned or locked aperture. The locked aperture operates to prevent passage of a captured fastener head. The walls of aperture portions 44 are tapered to create guide surfaces to aid in guiding the reception of a headed fastener into each aperture as the mounting plate is pushed down over the headed fasteners. The taper creates an aperture side wall that defines a wider opening at the bottom or reception end and a narrower opening at the top or capture end.

Figure 3:
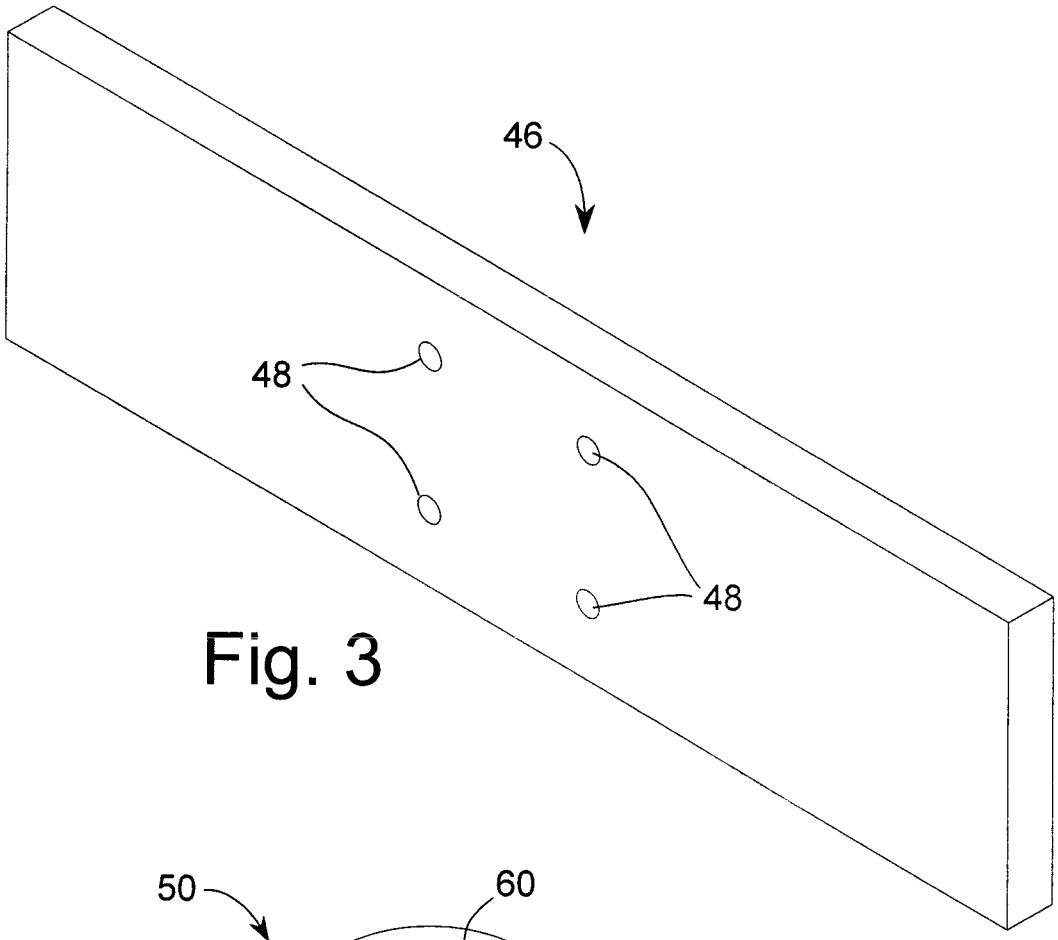
FIG. 3 is an isometric view of a first embodiment of a damping block, taken from the bottom and side.

A representative dampener 46, shown in FIG. 3, is sized and configured to be received and retained in a support zone 24. The damper may be configured with reception bores 48 that are sized and positioned to mate with pins 28 for positioning and retaining the damper on the bottom of the binding mounting plate. The width of the damper 46 may fit between the folded sides 27 of the support zone. The length of the damper may fit within the length of a support zone or it may be of a different length, depending upon functional factors. The thickness of a damper, at least at the tapered end of a support zone, is greater than the height of the folded side wall in order for the damper to be in interactional contact with the ski, and the thickness may be non-uniform. In particular, one end of the damper may be thicker than the other. The damper may be curved or straight.

The user's ski is equipped with means for selectively receiving and selectively retaining the binding mounting plate 22. As an example, suitable mounting points are applied to the user's ski, at an area central to the conventional binding mounting location of the ski. The mounting points are configured to mate with the binding mounting plate. Together, the mounting points and the binding mounting plate form the simplest embodiment of the quick release ski binding mounting system 20. The mounting points cover a shorter portion of the ski's length than required for a full binding, with the result that the ski is better able to flex in a natural arc, with less scrub area than would result from a conventional binding mounted directly to the ski.

Figure 4:
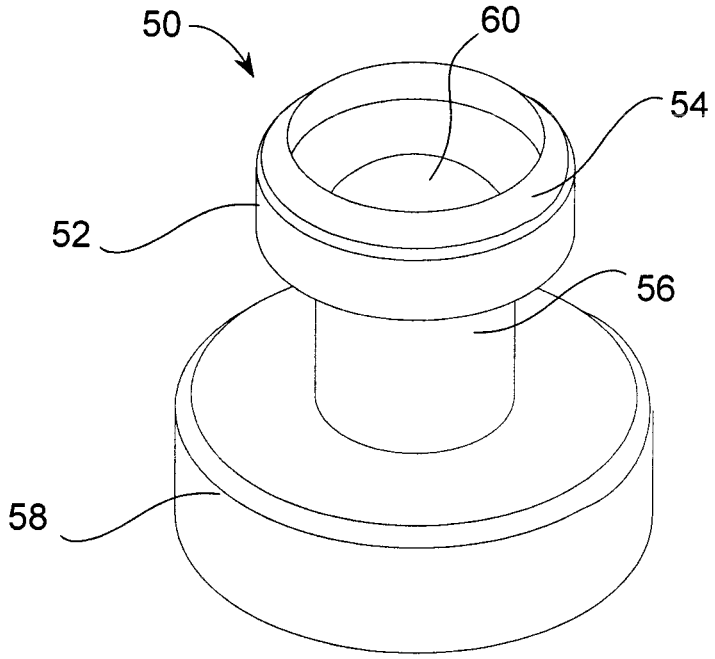
FIG. 4 is an isometric view of a ski mounting pin, taken from the top and side.

As one embodiment of mounting points, a plurality of ski mounting pins 50, as shown in FIG. 4, may be attached to the ski at locations suited to mate with the mounting plate. A ski mounting pin 50 is a headed fastener on an elongated body or shank. The shank supports the head, which can enter a full aperture formed by aligned aperture portions 44. The pin body remains in the aperture, while the head is locked behind the aperture when the aperture portions 44 are misaligned. A mounting pin 50 may have a mushroom head 52 with an annular angled or frusto-conical locating surface 54 at its top periphery. A narrower shank 56 below the head is sized to fit within the reduced diameter of an aperture formed by misaligned aperture portions 44. A base 58 provides a stable mounting against the top surface of a ski. A pass through bore 60 is sized to receive a normal binding mounting screw for fastening the mounting pin to a ski.

Figure 5:
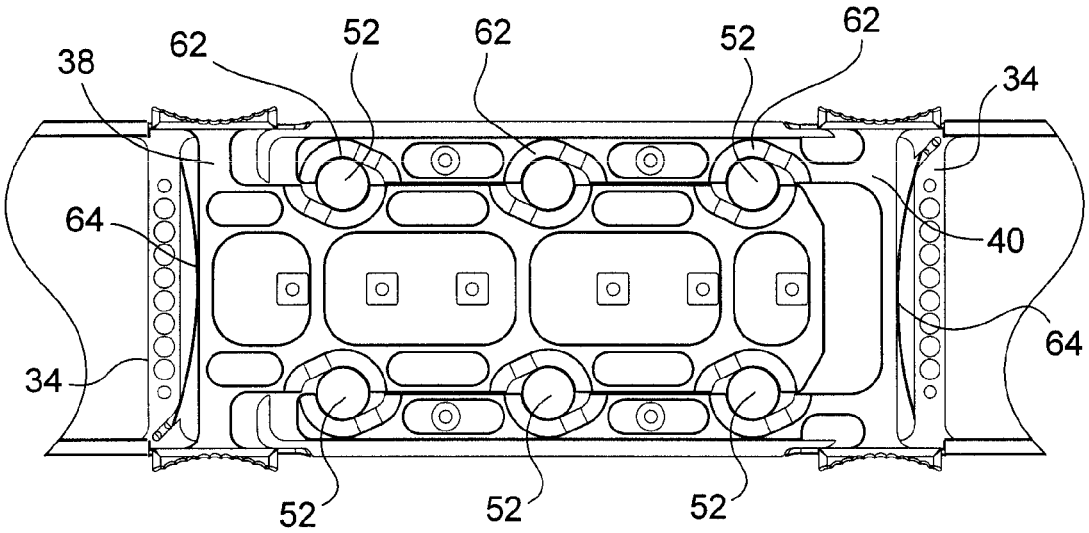
FIG. 5 is a fragmentary view of a binding mounting plate with locking plates installed, shown in open position.
Figure 6:
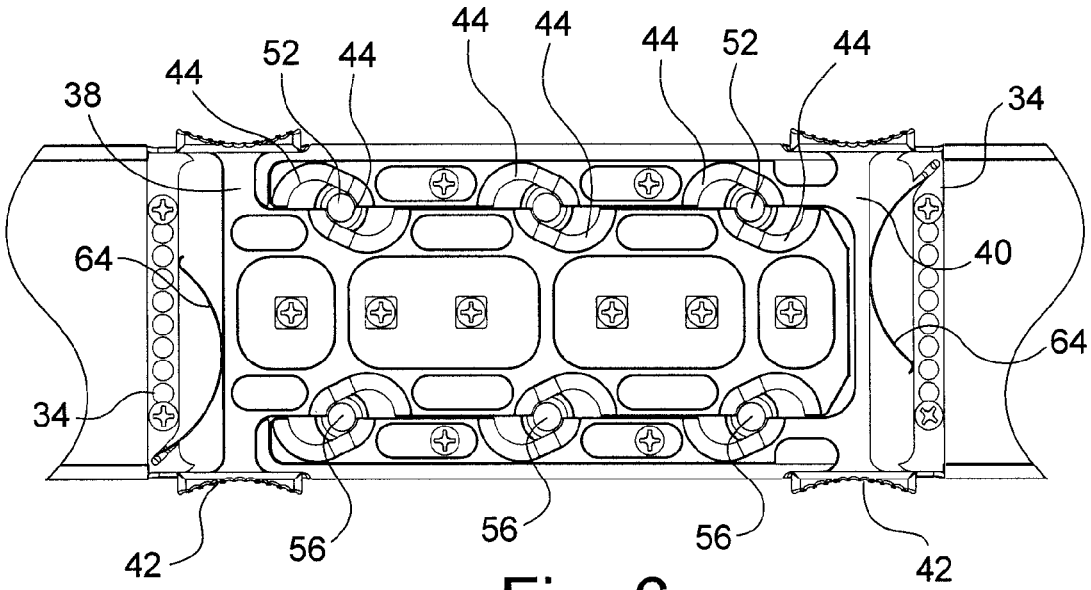
FIG. 6 is a view similar to FIG. 5, with locking plates in locked position.

FIGS. 5 and 6 show the positioning and operation of the locking plates within fastening zone 26. In FIG. 5, inner locking plate 38 and outer locking plate 40 are aligned, cooperatively forming full apertures 62. Each aligned, full aperture 62 is shown in combination with a received head 52 of a ski mounting pin 50. In this view, the heads 52 have passed above the apertures 62 and entered pin clearance holes 32, shown in FIG. 1, in the top wall of binding mounting plate 22, thus clearing the tapered tops of the apertures. In FIG. 6, the locking plates 38, 40 have been relatively moved, such as by longitudinally moving slide buttons 42 to misalign the aperture portions 44. Each misaligned aperture is shown in locked position, with an edge of an aperture partially underlying a ski mounting pin head 52 and snugly engaging a ski mounting pin shank 56 in three dimensions. A biasing means urges the locking plates toward misaligned position to secure the mounting plate onto a ski during use. As an example of such a biasing means, a resilient means such as a spring 64 can be applied to one or both locking plates.

FIG. 7 illustrates an example of such a spring 64. FIGS. 5 and 6 show compression spring 64 applied to each locking plate 38, 40. The spring is secured to a spring backing support 34 and operates between the spring backing support and a juxtaposed one of the two locking plates. FIG. 5 shows the springs in a more compressed configuration when the aperture portions are in open, aligned position, while FIG. 6 shows the springs in a less compressed configuration when the two aperture portions are in misaligned, locked position.

The height of a shank 56 is equal or greater than the height of a locking plate 38, 40 or an aperture 62, with the result that the locked apertures not only grip the shanks against movement in length and width but also secure the ski mounting pins against movement in height. FIG. 8 provides a further view of the binding mounting plate 22 assembled in optional combination with dampers 46, and with locking plates 38, 40 shown in engagement with the ski mounting pins. The ski mounting pins are shown with their mounting screws 66 protruding. In actual practice, these mounting screws 66 would fasten the mounting pins 50 to a ski before mounting plate 22 was applied to the mounting pins 50. For clarity, the ski is omitted from the view of FIG. 8.

As shown in FIGS. 9 and 10, a bottom plate or cover plate 68 is applied to contain the locking plates 38, 40 in the fastening zone 26. The bottom plate 68 forms suitable pass through holes 70 for allowing screws through the bottom plate and into screw mounts 30, FIG. 1. Pass through holes 72 are sized and positioned to align with apertures 62 for receiving ski mounting pins 50. In the view of FIG. 10, as in FIG. 7, the ski mounting pins 50 are shown with protruding mounting screws 66, which in practice would be fastened into a ski, which is omitted for clarity.

The view of FIG. 11 shows the assembly of elements of the quick release ski binding mounting system 20 as thus far described. The binding mounting plate 22 carries a ski binding 73 on its top face and establishes spacing between toe and heel pieces, as necessary. The ski binding 73 can be of substantially any design and, unlike the one shown in the drawing, need not have any particular interconnection between toe and heel, other than binding mounting plate 22. It may be anticipated that a shop technician will mount the ski binding 73 to binding mounting plate 22, using tools, templates, and positioning guides of the trade to fit the binding for use with the user's ski boot 74. The normal mounting techniques are used, establishing suitable positions for the binding components, drilling screw holes at mounting positions, and fastening the binding by inserting normal binding mounting screws 66. Dampers 46 are applied to mounting plate 22. Additional binding mounting screws 66 are used to secure ski mounting pins 50 to a ski 76 at an appropriate location to properly position boot 74 and binding 73 for use with ski 76.

Figure 12:
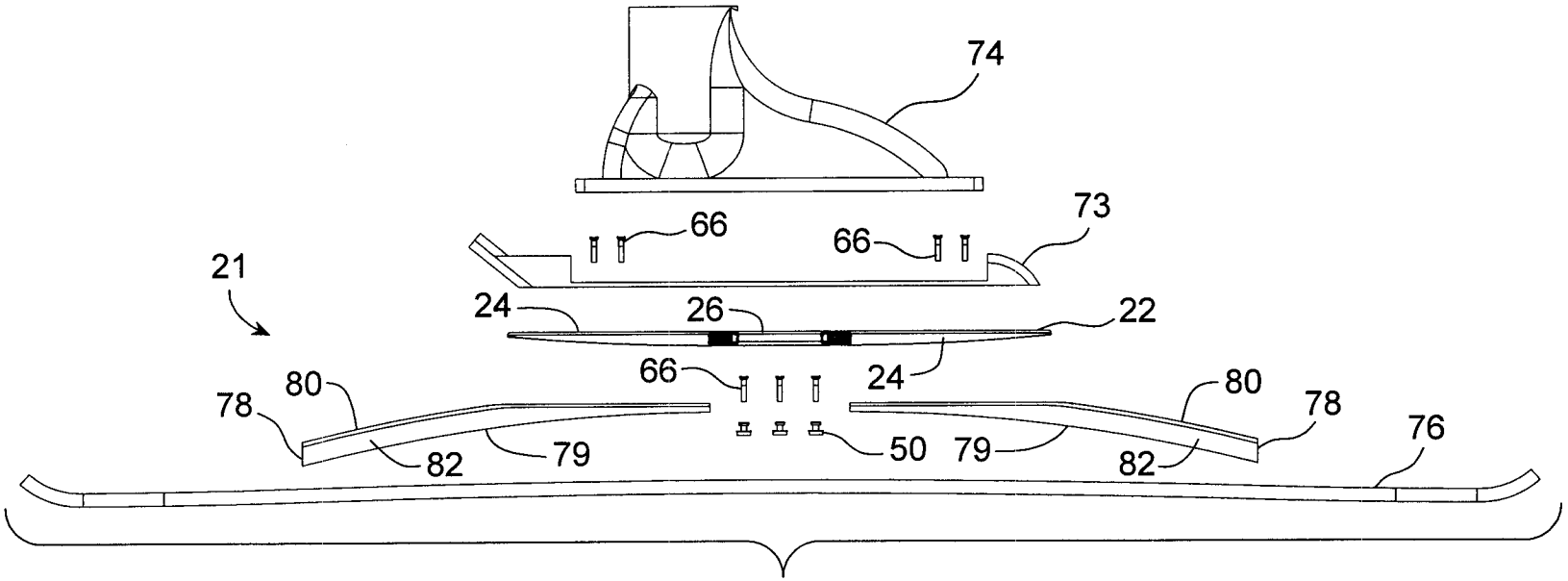
FIG. 12 is a view similar to FIG. 11, showing a damping block and camber adjusting element.

FIG. 12 shows a modified quick release ski binding mounting system 77 in which a vibration damper and a camber adjusting element are combined in a common structure 78. The combined components 78 may fit at lest partially into the support zones 24 and be positioned and retained by the locating pins 28, FIG. 1. Optionally, the combined components 78 are relatively longer than a support zone, with free end portions 79 extending beyond the ends of binding mounting plate 22. The components 78 may increase in relative thickness with increasing closeness to the opposite free ends, and this thickening can be applied to any of components 78 or previously described dampers 46. The combined components 78 may be configured with a downward curve through any portion of their length, but particularly through portions 79 near the free or outer ends, which applies the components 78 against the ski with increasing force. As described previously, dampers 46 also may be curved, especially to conform the damper's shape to the natural camber of the ski.

The components 78 may be combined in a sandwich structure. A top layer 80 is a relatively stiff, camber increasing layer. Examples of possible materials of construction include carbon fiber and metals, such as aluminum and titanium. The bottom layer 82 is a relatively softer, vibration damping layer. Examples of possible vibration damping materials of construction include resilient materials such as rubber, elastomers, and plastics. The binding mounting plate 22 applies the extending ends of components 78 with mechanical advantage against the top of the ski 76. The applied stiff layer 80 operates against ski 76 to adjust camber. Softer, damping layer 82 damps vibration over its extended length, thus increasing damping efficiency. In addition, the damping layer 82 isolates the ski from abrasion against stiffer layer 80.

Figure 13:
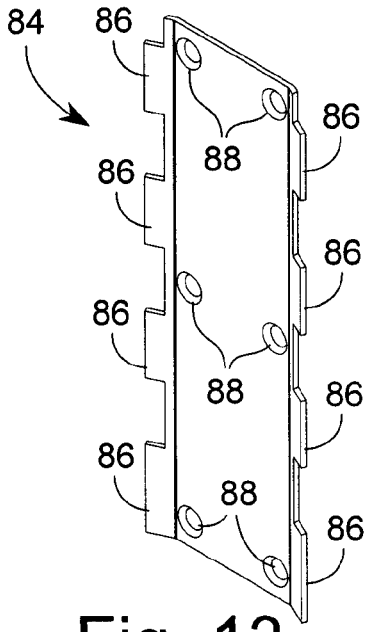
FIG. 13 is an isometric view of a first modified slide lock plate.
Figure 14:
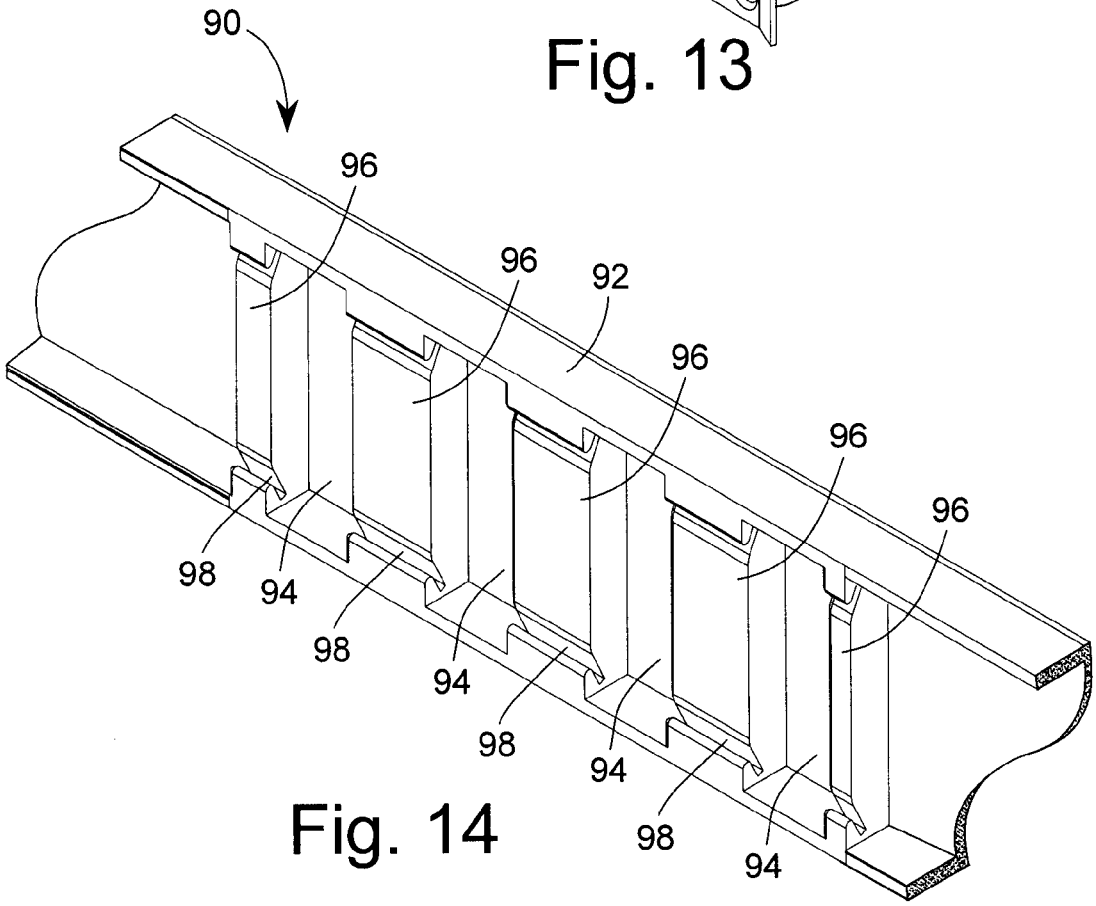
FIG. 14 is a fragmentary isometric view, taken from the bottom and side, showing an embodiment of a binding mounting plate with attached quick release binding mount assembly, adapted to engage the slide lock plate of FIG. 13.
Figure 15:
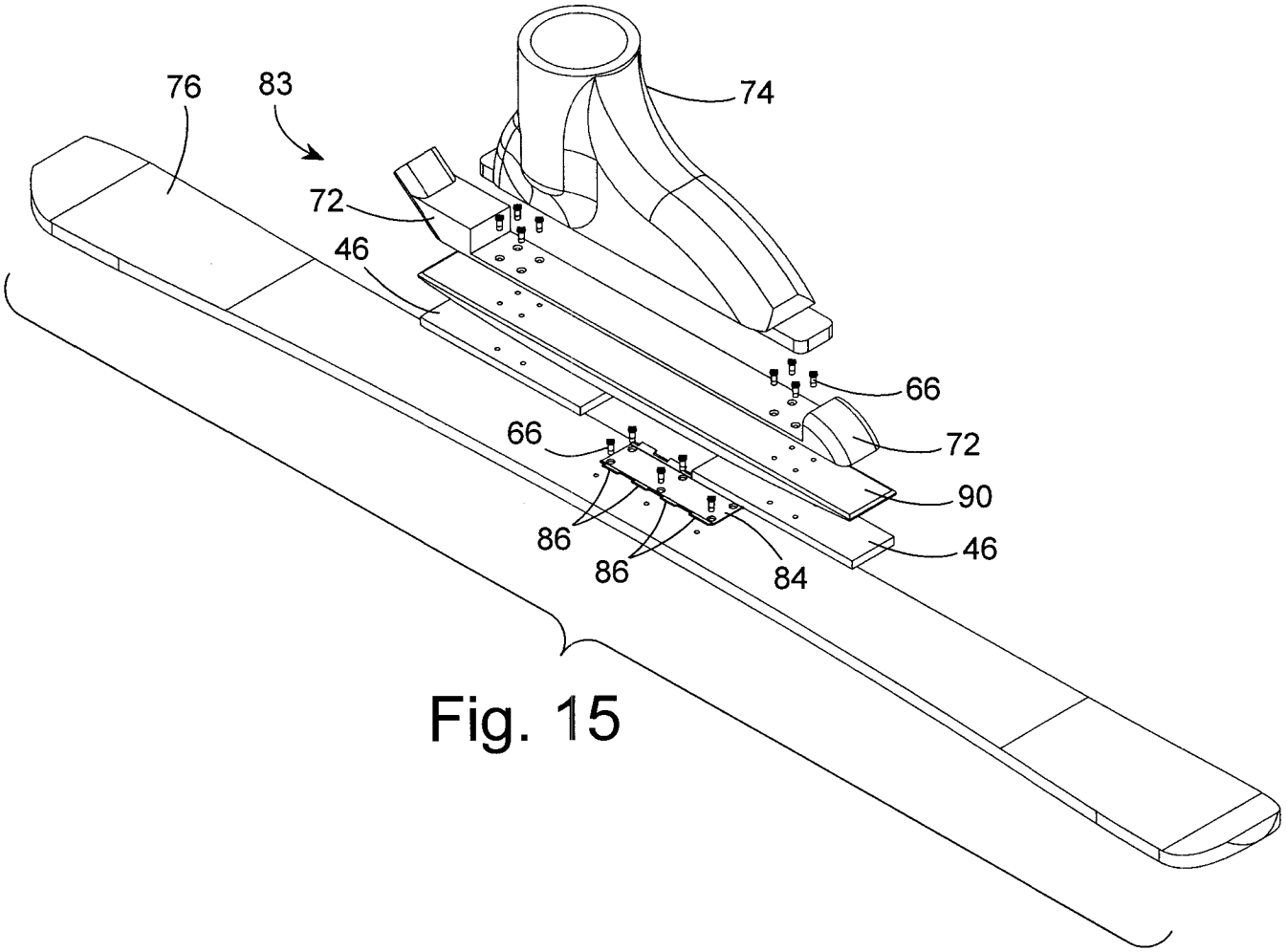
FIG. 15 is an isometric exploded view, showing a binding mounting plate adapted for use with the slide lock plate of FIG. 13, with ski, ski binding, and ski boot.

FIGS. 13-15 show another type of first and second mounting elements forming a modified quick release ski binding mounting system 83. This embodiment employs a slide lock plate 84 that can be mounted on a ski to provide the mounting points for the binding mounting plate. The slide lock plate 84 defines an array of longitudinally spaced apart, laterally extending lugs 86 along each lateral side edge of the plate. The lugs 86 may be angled up from the surface of the ski at a minor acute angle, such as about thirty degrees, so that the lugs have a major horizontal component for retaining the binding mounting plate against vertical displacement. The central body of the slide lock plate defines an array of screw holes 88 for use in permanently attaching the plate to the top surface of the ski, using conventional ski binding mounting screws 66. The location of the plate 84 on the ski is at a longitudinal position centered where bindings conventionally would be installed. The length of the plate, which might be about six to eight inches, is substantially shorter than the distance occupied by a conventionally installed ski binding. The relative shortness of the plate results in production of very little scrub area in the natural flex of the ski.

The mating mounting element is binding mounting plate 90 of FIG. 14, which is configured with a fastening zone 92 that mates with the array of lugs 86. The mounting elements in fastening zone 92 may be an attached structure to the binding mounting plate, or the mounting elements in fastening zone 92 may be unitary with the binding mounting plate. A spaced series of transverse recesses 94 or other cavities is arranged to receive lugs 86. For example, if four lugs 86 are located on each side of plate 88, in four transverse pairs, then four transverse recesses 94 in zone 92 are correspondingly disposed, each to mate with one pair of the lugs. The recesses are spaced apart by dividers 96, each with a longitudinal slot 98 positioned to align with a lug 86 when the lugs are fully received in the recesses 94. Binding mounting plate 90 can be slid in a longitudinal direction to slide slots 98 over lugs 86, thereby locking binding mounting plate 90 against vertical separation from the ski. A selectively releasable spring latch can be positioned to lock the plate 84 and plate 90 in a fixed longitudinal position when the lugs are fully inserted into slots 98.

In use, the binding mounting plate 90 is pushed down on the slide lock plate 84 to receive the lugs 86 in the mating recesses 94 of plate 90. Then the quick release binding mounting plate 90 is slid longitudinally to cause the lugs 86 to enter the longitudinal channels 98, thereby fastening the quick release binding mount assembly in place. The binding is removed from the ski by the reverse procedure.

Figure 16:
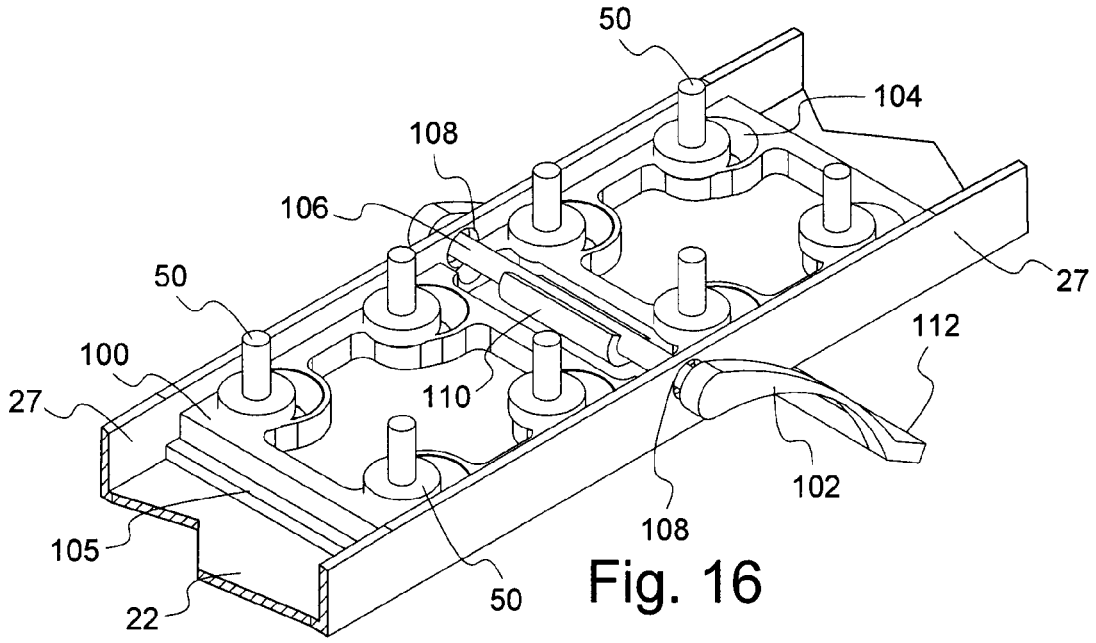
FIG. 16 is a fragmentary isometric view of a binding mounting plate, taken from the bottom and side, showing a further modification of a slide lock plate with a control lever and showing ski mounting pins installed.
Figure 17:
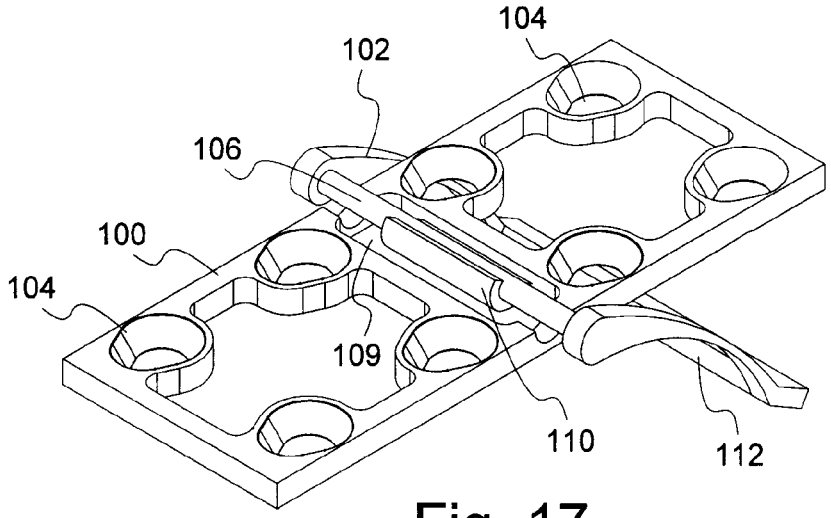
FIG. 17 is an isometric view of the modified slide lock plate of FIG. 16, without ski mounting pins installed.

With reference to FIGS. 16 and 17, a modified configuration for one of the mounting elements is formed by a locking plate 100 on a binding mounting plate 22. The locking plate 100 slides longitudinally with respect to binding mounting plate 22 under control of a hand operated lever 102 that slides plate 100 fore and aft on mounting plate 22, between locked and open positions. As shown in FIG. 17, the slide plate 100 has an array of teardrop shaped openings 104 with tapered or chamfered walls for guiding a suitably configured array of ski mounting pins 50 into the openings. The teardrop shaped openings 104 have a narrow end arranged at one longitudinal end, such as approximately toward the left according to the view of FIG. 17. The openings 104 have a wide end positioned at the opposite longitudinal end, such as approximately toward the right according to the view of FIG. 17. When slide plate 100 is allowed to shift toward one selected position, such as aft position, which may be toward the left in the view of FIG. 17, the openings 104 are able to engage with the array of ski mounting pins 50 by receiving the pin heads through the wide or rounder ends of the openings. The pin heads pass through apertures 104 and lodge in aligned cavities of backing plate 105. Then lever 102 is operated to move slide plate 100 to the opposite selected position, such as to the right or fore position, openings 104 are longitudinally shifted to engage the shank of pin bodies 52 in the narrower ends of the teardrop openings 104, thereby locking the engaged heads of pins 50 behind the slide plate 100 and in the fixed structure of backing plate 105.

A cross-shaft 106 of lever 102 is mounted on the binding mounting plate 22 at the longitudinally fixed location of apertures 108 in side walls 27, roughly at the midpoint of the length of the binding mounting plate 22. The cross-shaft fits into a transverse position control cavity 109 in the slide plate 100. A cam 110 on the cross-shaft acts against at least one of the fore or aft cavity walls to reposition and secure the slide plate. When lever 102 is in a selected end position, such as to the right in FIG. 16, the cam 110 is positioned to extend in a first longitudinal direction, such as to the right with respect to mounting plate 22. In this position, the cam has moved the slide plate 100 in the one direction, such as to the right or fore direction in FIGS. 16 and 17. By its continued presence in this fixed position, the cam secures the slide plate 100 in the first or fore longitudinal position. Lever 102 has a flat handle 112 that lies against the top of mounting plate 22 when lever 102 is in locked position. During use, the user's ski boot is atop the flat handle portion 112, ensuring that the slide plate 100 will remain in engaged position with respect to pins 50.

Raising the lever 102 by about one-quarter rotation, to an upright or normal position to the binding mounting plate 22, releases the cam from securing the slide plate 100 in fixed longitudinal position. The slide plate 100 is free to move longitudinally, which allows the pins 50 to be released from openings 104. The upright, released position of lever 102 is a safety feature because it prevents the binding from being used until the lever is lowered to locked position.

Figure 18:
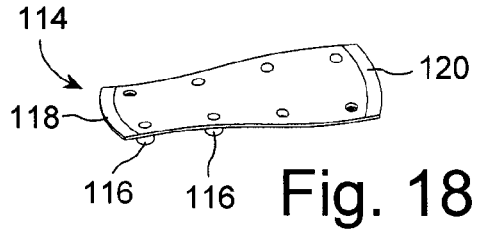
FIG. 18 is an isometric view of a rotary locking plate.
Figure 19:
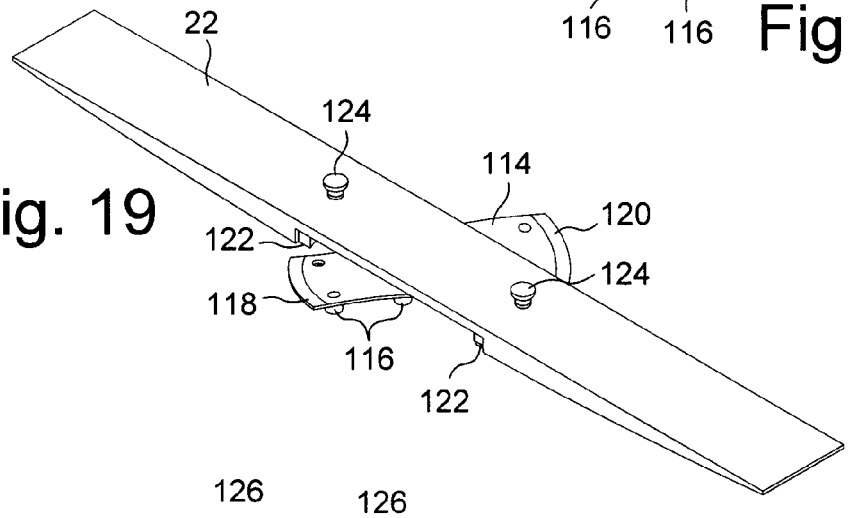
FIG. 19 is an isometric view of a binding mounting plate positioned to engage a rotary locking plate of FIG. 19.
Figure 20:
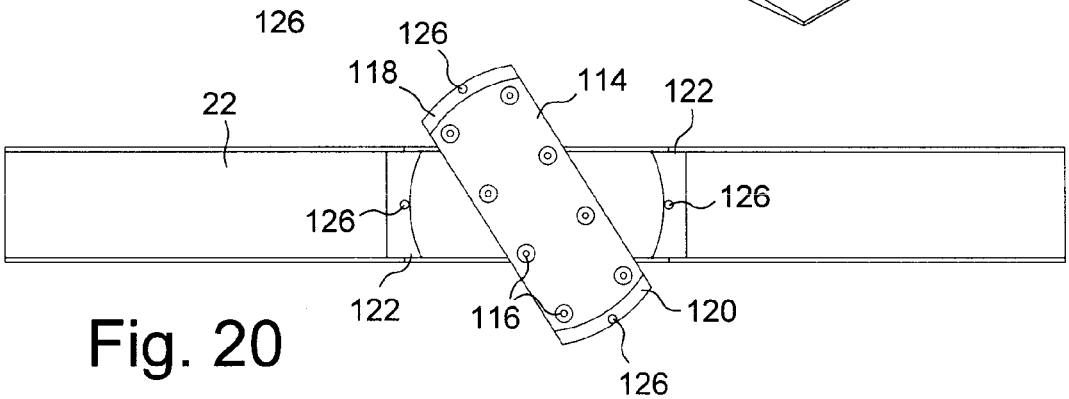
FIG. 20 is a bottom plan view of the binding mounting plate and rotary locking plate positioned as shown in FIG. 19.

FIGS. 18-20 show a first mounting element that employs a modified, rotary locking plate 114 that is permanently attached to the ski. The plate 114 is irregular in contour, which may be arched, twisted, or configured as a segment of a helix, to provide a strong frictional engagement in reception slots described, below. The plate is attached to the top of a ski by screws passing through an array of standoffs 116, which are varied in height to establish approximately a planar level where the standoffs contact the ski. The fore end 118 and aft end 120 of plate 114 define arced ends with a radius of about one-half the length of the plate 114. The arced ends are configured to be engaged in a second mounting element consisting of slotted bodies 122 that define arcuate reception slots, which form matching arcs where they are located near opposite ends of the central fastening zone 26 of the binding mounting plate 22.

The binding mounting plate 22 carries the centrally located slotted bodies 122 that define opposed reception slots. The binding mounting plate 22 can be installed on the ski by placing the fastening zone 26 of plate 22 over the position of locking plate 114 on the ski, at an angle of about sixty degrees as suggested by FIGS. 19 and 20. The binding mounting plate 22 then is depressed against the locking plate 114 to compress the irregular contours of plate 114 until the arced ends 118, 120 can enter the slots of bodies 122. Subsequently, the binding mounting plate is rotated into longitudinal alignment with the ski, causing arced ends 118, 120 to enter the slots. A pair of securing pins 124 are positioned to move through the binding mounting plate 22 and slotted bodies 122 in vertical alignment with each slot. The securing pins 124 are pressed down and through matching holes 126 in arced ends 118, 120, as well as bodies 122 to lock the locking plate 114 in alignment with the binding mounting plate 22. Releasing the binding mounting plate 22 from a ski requires raising pins 124, and twisting the binding mounting plate 22 to release it from lock plate 118.

Figure 21:
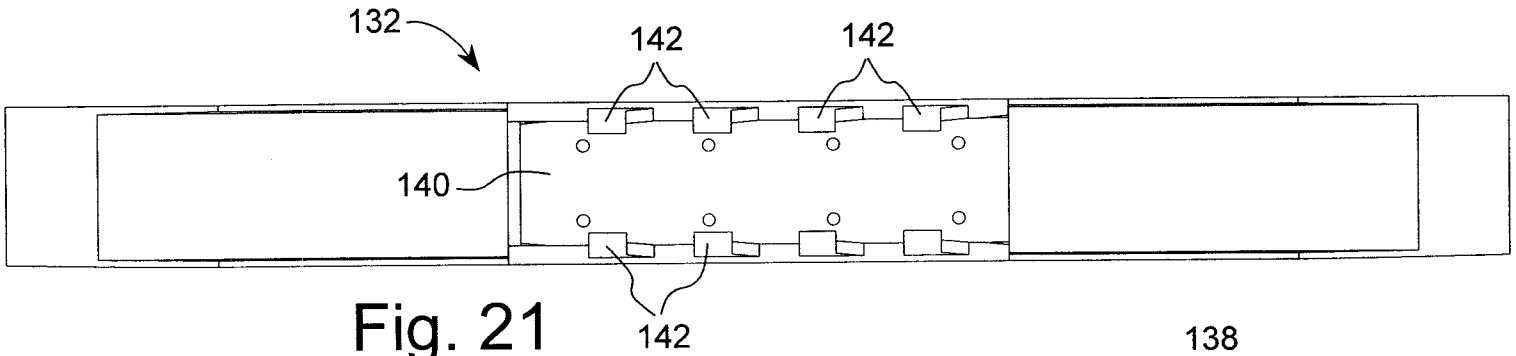
FIG. 21 is a bottom plan view of a binding mounting plate with further modified slide lock plate attached.
Figure 22:
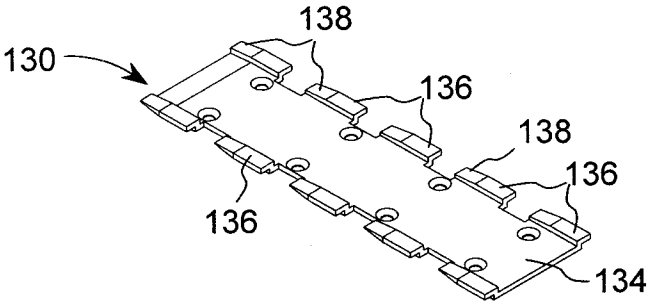
FIG. 22 is an isometric view of a slide lock plate configured to mates with the slide lock plate of FIG. 21.

FIGS. 21-22 show another modified quick release ski binding mounting system similar in operation to the slide lock system 83 shown in FIGS. 13-15. This embodiment employs a slide lock plate 130 that provides the mounting points for a matching fastening plate 140 mounted to a binding mounting plate 132 similar to what has been described, above. The slide lock plate 130 has a base panel 134 that defines an array of screw holes for mounting the base panel 134 to the top surface of a ski. The slide lock plate 130 also defines two rows of longitudinally spaced apart, laterally extending lugs 136 located along each lateral side edge of the plate 130. The lugs 136 are disposed in a plane that is spaced above base plate 134. The lugs are parallel to the top surface of the base 134 and correspondingly parallel to the top of the ski. Each lug has a tapered or wedge shaped front 138 that guides engagement with binding mounting plate 132. The location of the plate 130 on the ski is at a longitudinal position centered where bindings conventionally would be installed. The length of the plate, which might be about six to eight inches, is substantially shorter than the distance occupied by a conventionally installed ski binding. The relative shortness of the plate results in production of very little scrub area in the natural flex of the ski.

A binding mounting plate 132 of FIG. 21 is configured with a fastening plate 140 that carries an array of cover tabs over spaced pockets that are sized and positioned to receive and mate with the array of lugs 136. The pockets are defined behind two rows of longitudinally spaced apart, laterally extending cover tabs 142 that are located along each lateral side edge of the fastening plate 140. The tabs 142 are disposed in a plane that is spaced below plate 140, or offset toward the ski after the binding mounting plate 140 is installed on the ski, such that a pocket is defined between each tab 142 and the fastening plate 140. Binding mounting plate 132 can be slid in a longitudinal direction to slide cover tabs 142 under lugs 136, thereby locking binding mounting plate 132 against vertical separation from the ski. A selectively releasable latch can be positioned to lock fastening plate 140 in engagement with slide lock plate 130 in a fixed longitudinal position, with the lugs 136 fully inserted behind cover tabs 142.

In use, the binding mounting plate 132 is pushed down on the slide lock plate 134 to lower the cover tabs 142 below the level of lugs 136. Then the binding mounting plate 132 is slid longitudinally to cause the lugs 136 to enter the pockets behind cover tabs 142, thereby fastening the binding mounting plate in place. The binding is removed from the ski by the reverse procedure.

In the various embodiments of the invention described, above, components of the quick release system are a mated pair or cooperating first and second elements. These elements can function whether in the described position or in a reversed position. Thus, one component of a mated pair has been described as an element of the binding mounting plate, while the other component has been described as an element of the ski. As such, the mated pair can function similarly whichever is mounted to a ski and whichever is mounted to the binding mounting plate. It should be understood that a reversal of the components is within the scope of the invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

What is claimed is:

1. A quick release ski binding mounting system, for use with a ski having a top surface and with a ski boot binding having a mounting structure disposed over a preselected length, comprising:

a two-element mating pair of quick release fastener components mountable between a ski binding and a ski to selectively engage and disengage with respect to each other, thereby enabling the quick attachment or removal of a binding with respect to a ski;

wherein a first quick release fastener component of said pair of quick release fastener components, in use, attaches at the bottom of the binding, and a second quick release fastener component of said pair of quick release fastener components attaches, in use, to the top surface of a ski;

wherein said pair of quick release fastener components is of preselected length that is shorter than said preselected length of a binding mounting structure, in use mounting a binding to a ski over a shorter attachment footprint on the ski than the resulting footprint of directly mounting of the binding on the ski, such that the scrub portion of the ski is reduced in length;

a binding mounting plate of preselected length, having top and bottom faces, in use carrying said ski boot binding on the top face thereof, and carrying said first quick release element on the bottom face thereof; and wherein the preselected length of said binding mounting plate is longer than the preselected length of the binding mounting structure, wherein opposite end portions of the binding mounting plate are support zones, in use carrying opposite ends of the binding on the binding mounting plate, and a center zone of the binding mounting plate is a fastening zone located between the two support zones and carrying said first quick release element.

2. The quick release ski binding mounting system of claim 1, further comprising:

a vibration damping block attached to the bottom of said binding mounting plate at least at one of said support zones and extending below the binding mounting plate for, in use, contacting the ski to damp vibrations.

3. The quick release ski binding mounting system of claim 1, further comprising:

a pair of camber adjusting blocks attached to the bottom of said binding mounting plate, with one camber adjusting block attached at each of said support zones and extending below the binding mounting plate for, in use, bending the ski to adjust camber.

4. The quick release ski binding mounting system of claim 1, wherein:

one of said quick release fastener components comprises a pin body having an enlarged head at one end; and the other of said quick release fastener components comprises a mated pair of aperture-forming plates that slide longitudinally with respect to one another at juxtaposed side edges that each define a portion of a longitudinally elongated aperture that varies in configuration according to relative longitudinal position between said two plates, wherein at a first relative position the aperture is sized large enough to pass said head, and at a second relative position the aperture is sized small enough to block passage of said head while remaining large enough to contain the pin body in the aperture;

whereby the first and second quick release fastener components are fastened together by first positioning the aperture-forming plates to first relative position, passing said head through the aperture with the pin body remaining in the aperture, repositioning the aperture-forming plates to second relative position to thereby block passage of the head while retaining the pin body in the aperture; and the first and second quick release elements are separated by repositioning the aperture-forming plates to first relative position, and withdrawing the pin body and head from the aperture.

5. The quick release ski binding mounting system of claim 1, wherein:

one of said first and second quick release fastener components comprises a first slide plate having a longitudinal axis and laterally extending lugs; and the other of said quick release fastener components comprises a mated second slide plate having a longitudinal axis and laterally positioned lug receiving pockets positioned to receive said lugs by longitudinal sliding motion between the two slide plates;

wherein the slide plates are fastenable, in use, between a binding and a ski with longitudinal axes parallel to a longitudinal axis of the ski, such that the binding can be mounted or dismounted with respect to the ski by longitudinal linear sliding motion between the first and second slide plates.

6. The quick release ski binding mounting system of claim 1, wherein:

one of said quick release fastener components comprises a mounting pin body having an enlarged head at one end; and the other of said quick release fastener components comprises:

an apertured slide plate having a longitudinal axis of sliding movement, wherein said apertures are configured with a portion near one longitudinal end thereof to pass said enlarged head and a portion near an opposite longitudinal end thereof to block passage of the enlarged head; and a dual-position lever arranged to move into a first position where the lever slides the slide plate from an open position where the apertures can pass the enlarged head to a blocking position where the apertures block passage of the enlarged head, and to lock the slide plate in said blocking position; and wherein said dual position lever is arranged to move into a second position where the lever releases the slide plate from blocking position;

whereby the first and second quick release fastener components are fastened together by positioning the lever into second position; relatively positioning the first and second quick release fastener components to pass the head of a mounting pin body through an aperture of the slide plate with the pin body remaining in the aperture, and repositioning the slide plate by moving the lever into first position to thereby block passage of the head while retaining the pin body in the aperture; and the first and second quick release elements are separated by repositioning the lever to second relative position, and withdrawing the pin body and head from the aperture.

7. A quick release ski binding mounting system, comprising:

a ski having a top surface;

a ski boot binding having a mounting structure disposed over a preselected length;

a two-element mating pair of first and second quick release fastener components mountable between said ski binding and said ski to selectively engage and disengage with respect to each other, thereby enabling the quick attachment or removal of the binding with respect to the ski;

a binding mounting plate of preselected length, having top and bottom faces, carrying said ski boot binding on the top face thereof, and carrying said first quick release fastener component on the bottom face thereof;

wherein the second quick release fastener component is attached to the top surface of a ski;

wherein said pair of quick release fastener components is of preselected length that is shorter than said preselected length of the binding mounting structure, whereby the quick release fastener components produce a mounting footprint on the ski that is shorter than the footprint of directly mounting the binding on the ski, such that the scrub portion of the ski is reduced in length;

wherein, the preselected length of said binding mounting plate is longer than the preselected length of the binding mounting structure;

opposite end portions of the binding mounting plate are support zones, carrying opposite ends of the binding on the binding mounting plate; and a center zone of the binding mounting plate is a fastening zone located between the two support zones and carrying said first quick release component.

8. The quick release ski binding mounting system of claim 7, further comprising:

a vibration damping block attached to the bottom of said binding mounting plate at least at one of said support zones and extending below the binding mounting plate into contact with the ski, thereby damping vibrations.

9. The quick release ski binding mounting system of claim 7, further comprising:

a pair of camber adjusting blocks attached to the bottom of said binding mounting plate, with one camber adjusting block attached at each of said support zones and extending below the binding mounting plate and bending the ski by a preselected amount, thereby adjusting camber.

10. The quick release ski binding mounting system of claim 7, wherein:

one of said quick release fastener components comprises a pin body having an enlarged head at one end; and the other of said quick release fastener components comprises a mated pair of aperture-forming plates that slide longitudinally with respect to one another at juxtaposed side edges that each define a portion of a longitudinally elongated aperture that varies in configuration according to relative longitudinal position between said two plates, wherein at a first relative position the aperture is sized large enough to pass said head, and at a second relative position the aperture is sized small enough to block passage of the head while remaining large enough to contain the pin body in the aperture;

whereby the first and second quick release fastener components are fastened together by first positioning the aperture-forming plates to first relative position, passing the head through the aperture with the pin body remaining in the aperture, repositioning the aperture-forming plates to second relative position, thereby blocking passage of the head while retaining the pin body in the aperture; and the first and second quick release elements are separated by repositioning the aperture-forming plates to first relative position, and withdrawing the pin body and head from the aperture.

11. The quick release ski binding mounting system of claim 7, wherein:

one of said first and second quick release fastener components comprises a first slide plate having a longitudinal axis and laterally extending lugs; and the other of said quick release fastener components comprises a mated second slide plate having a longitudinal axis and laterally positioned lug receiving pockets positioned to receive said lugs of the first slide plate by longitudinal sliding motion between the two slide plates;

wherein the slide plates are fastened between said binding and said ski with longitudinal axes parallel to said longitudinal axis of the ski, such that the binding is mountable and dismountable with respect to the ski by longitudinal linear sliding motion between the first and second slide plates.

12. The quick release ski binding mounting system of claim 7, wherein:

one of said quick release fastener components comprises a mounting pin body having an enlarged head at one end; and the other of said quick release fastener components comprises:

an apertured slide plate having a longitudinal axis of sliding movement, wherein said apertures are configured with a portion near one longitudinal end thereof sized to pass said enlarged head, and the apertures are configured with a portion near an opposite longitudinal end thereof sized to block passage of the enlarged head; and a dual-position lever arranged to move to a first position to slide the slide plate from an open position where the apertures can pass the enlarged head to blocking position where the apertures block passage of the enlarged head, and where the lever locks the slide plate in said blocking position; and wherein said dual position lever is arranged to move to a second position where the lever releases the slide plate from blocking position;

whereby the first and second quick release fastener components are fastened together by positioning the lever into second position; relatively positioning the first and second quick release fastener components to pass the head of a mounting pin body through an aperture of the slide plate with the pin body remaining in the aperture, and repositioning the slide plate by moving the lever into first position, thereby blocking passage of the head while retaining the pin body in the aperture; and the first and second quick release elements are separated by repositioning the lever to second relative position, and withdrawing the pin body and head from the aperture.

13. A quick release ski binding mounting system, for use with a ski having a top surface and with a ski boot binding having a mounting structure disposed over a preselected length, comprising:

a two-element mating pair of quick release fastener components mountable between a ski binding and a ski to selectively engage and disengage with respect to each other, thereby enabling the quick attachment or removal of a binding with respect to a ski;

wherein a first quick release fastener component of said pair of quick release fastener components, in use, attaches at the bottom of the binding, and a second quick release fastener component of said pair of quick release fastener components, in use, attaches to the top surface of a ski;

wherein said pair of quick release fastener components is of preselected length that is shorter than said preselected length of a binding mounting structure, in use mounting a binding to a ski over a shorter attachment footprint on the ski than the resulting footprint of directly mounting of the binding on the ski, such that the scrub portion of the ski is reduced in length; and wherein said first quick release fastener component has opposite end portions constituting support zones suited to carry ends of a binding and that are configured to be spaced with increasing separation toward the opposite ends thereof from the top surface of a ski when said ski is unflexed, allowing the ski to flex without interference from the ends of the first quick release fastener component.

* * * * *